US011203989B2

(12) United States Patent
Kondo et al.

(10) Patent No.: US 11,203,989 B2
(45) Date of Patent: Dec. 21, 2021

(54) ENGINE START CONTROL DEVICE

(71) Applicant: HONDA MOTOR CO., LTD., Tokyo (JP)

(72) Inventors: Tetsuya Kondo, Wako (JP); Koichi Shimamura, Wako (JP); Takeshi Yanagisawa, Wako (JP); Yoshiaki Takeuchi, Wako (JP); Hideki Uematsu, Wako (JP); Mamoru Uraki, Wako (JP); Naoki Murasawa, Wako (JP); Atsushi Hatayama, Wako (JP); Hirofumi Wakayama, Wako (JP); Tomoya Makabe, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 178 days.

(21) Appl. No.: 16/497,462

(22) PCT Filed: Mar. 27, 2017

(86) PCT No.: PCT/JP2017/012415
§ 371 (c)(1),
(2) Date: Sep. 25, 2019

(87) PCT Pub. No.: WO2018/179059
PCT Pub. Date: Oct. 4, 2018

(65) Prior Publication Data

US 2020/0025115 A1 Jan. 23, 2020

(51) Int. Cl.
*F02N 11/08* (2006.01)
*F02N 11/10* (2006.01)
(Continued)

(52) U.S. Cl.
CPC ..... *F02D 29/02* (2013.01); *F02D 41/266* (2013.01); *F02N 11/0807* (2013.01);
(Continued)

(58) Field of Classification Search
CPC ..... F02N 11/0807; F02N 11/0811; F02N 11/0848; F02N 11/0862; F02N 11/10;
(Continued)

(56) References Cited

U.S. PATENT DOCUMENTS 6,800,952 B2 * 10/2004 Blackburn ..... F02N 11/04 123/179.3
7,150,253 B2 * 12/2006 Itou ..... F02D 41/266 123/179.3
(Continued)

FOREIGN PATENT DOCUMENTS

JP 63-186963 8/1988
JP 2005-180381 7/2005
(Continued)

OTHER PUBLICATIONS

International Search Report and Written Opinion for International Application No. PCT/JP2017/012415 dated May 9, 2017, 10 pages.

*Primary Examiner* — Erick R Solis
(74) *Attorney, Agent, or Firm* — Amin, Turocy & Watson, LLP

(57) ABSTRACT

An engine start control device is provided with: a starter relay that is provided between a battery and a starter motor; a start abnormality determining means that determines the occurrence of start abnormality of an engine; and a start control means, which turns on the starter relay, and starts supplying power from the battery to the starter motor in the cases where a start instruction signal is inputted from a start switch, and which turns off the starter relay in the cases where the start abnormality determining means determined the occurrence of start abnormality of the engine.

16 Claims, 7 Drawing Sheets

(51) Int. Cl.

| | |
|---|---|
| ***F02N 19/00*** | (2010.01) |
| ***F02D 29/02*** | (2006.01) |
| ***F02D 41/26*** | (2006.01) |
| *F02D 45/00* | (2006.01) |

(52) U.S. Cl.
CPC ..... *F02N 11/0811* (2013.01); *F02N 11/0848* (2013.01); *F02N 11/10* (2013.01); *F02N 11/108* (2013.01); *F02D 45/00* (2013.01); *F02N 11/08* (2013.01); *F02N 2011/0874* (2013.01); *F02N 2200/022* (2013.01); *F02N 2300/2006* (2013.01)

(58) Field of Classification Search
CPC .... F02N 11/101; F02N 11/106; F02N 11/108; F02N 19/004; F02N 2011/0874; F02N 2200/022; F02N 2300/2011
USPC ..... 123/179.2, 179.3, 182.1
See application file for complete search history.

(56) References Cited

U.S. PATENT DOCUMENTS

| | | | | |
|---|---|---|---|---|
| 7,483,784 | B2 * | 1/2009 | Hata | B60R 25/02113 123/179.2 |
| 10,808,671 | B2 * | 10/2020 | Greene | F02N 11/087 |
| 2005/0132994 | A1 | 6/2005 | Itou et al. | |
| 2010/0247987 | A1 * | 9/2010 | Holung | B60L 3/04 429/62 |
| 2013/0042833 | A1 | 2/2013 | Hartmann | |
| 2015/0260141 | A1 * | 9/2015 | Fujita | F02N 11/105 290/38 C |
| 2018/0149104 | A1 * | 5/2018 | Yamashita | F02D 41/062 |
| 2020/0109689 | A1 * | 4/2020 | Heininger | F02N 11/0807 |

FOREIGN PATENT DOCUMENTS

| | | |
|---|---|---|
| JP | 2006-161604 | 6/2006 |
| JP | 2007-255383 | 10/2007 |
| JP | 2015-109191 | 6/2015 |

* cited by examiner

ENGINE START CONTROL DEVICE

TECHNICAL FIELD

The present invention relates to an engine start control device that by supplying electric power to a starting motor from a battery and thereby rotating a crank shaft, starts an engine.

BACKGROUND ART

Japanese Laid-Open Patent Publication No. 2006-161604 discloses that when, at a time that a crank shaft of an engine is rotated by supplying electric power to a starting motor from a battery whereby said engine is started, an engine speed is a certain speed or less and a certain time has elapsed from a start of the starting, a starting abnormality of the engine is judged to have occurred, and freeze data indicating that judgment result is stored in a memory.

SUMMARY OF INVENTION

However, when, after judgment of the starting abnormality of the engine, starting of said engine continues to be performed, there is a possibility of an excessive load being applied to the battery from the starting motor. Hence, it is desired that the battery is appropriately protected.

Accordingly, the present invention has an object of providing an engine start control device that can appropriately protect a battery during starting of an engine.

An engine start control device according to the present invention is an apparatus that by supplying electric power to a starting motor from a battery and thereby rotating a crank shaft of an engine coupled to said starting motor, starts said engine, and has the following features.

First Feature: The engine start control device includes: a switch provided between the battery and the starting motor; a starting abnormality determining unit that determines whether a starting abnormality of the engine has occurred or not; and a starting control unit that in the case that there has been a starting instruction of the engine from outside, sets the switch to ON to start electric power supply to the starting motor from the battery, while in the case that occurrence of a starting abnormality of the engine has been determined by the starting abnormality determining unit, sets the switch to OFF.

Second Feature: The starting abnormality determining unit finalizes a determination result of occurrence of the starting abnormality when a first prescribed time has elapsed from said starting abnormality occurring. The starting control unit sets the switch to OFF based on the finalized determination result.

Third Feature: A starting abnormality of the engine refers to a state where during starting of the engine, rotation of the crank shaft stops even when the starting motor rotates said crank shaft. The starting abnormality determining unit finalizes a determination result of occurrence of the starting abnormality when a state of the crank shaft not rotating as far as a certain angle corresponding to the first prescribed time has continued from said crank shaft stopping rotation.

Fourth Feature: The starting abnormality determining unit is configured to include a timer that clocks the first prescribed time from occurrence of the starting abnormality.

Fifth Feature: The first prescribed time is a time of 0.3 [s] or less.

Sixth Feature: The starting control unit maintains the switch at OFF even when there is a starting instruction of the engine from outside, until a second prescribed time elapses from the switch being set to OFF based on the finalized determination result.

Seventh Feature: The engine includes a decompression device that reduces a pressure present in a cylinder during starting of said engine. The starting abnormality determining unit determines occurrence of the starting abnormality due to the decompression device not operating normally.

Eighth Feature: The switch is a relay.

Ninth Feature: The battery incorporates a fuse.

Tenth Feature: The battery is a battery incorporating the fuse.

Eleventh Feature: The starting control unit sets the switch to OFF when the starting abnormality determining unit has determined occurrence of the starting abnormality, in the case where a start switch of a vehicle provided with the engine continues to be pressed whereby a signal indicating the starting instruction continues to be outputted from said start switch.

Due to the first feature of the present invention, when occurrence of the starting abnormality has been determined, the switch is set to OFF whereby electric power supply from the battery to the starting motor is stopped. As a result, an excessive load is not applied to the battery from the starting motor, hence said battery can be appropriately protected. Moreover, by the switch being promptly set to OFF, it can be avoided that an excessive load is applied to the battery at a time of a starting abnormality of the engine, so a wiring connected to a terminal of the battery can be thinned (a cross-sectional area of the wiring can be reduced).

Due to the second feature of the present invention, a determination result of occurrence of the starting abnormality is finalized when the first prescribed time has elapsed from occurrence of said starting abnormality. This makes it possible for setting to OFF of the switch to be accurately performed based on the finalized determination result.

Due to the third feature of the present invention, a determination result of occurrence of the starting abnormality is finalized when a state of not rotating as far as a certain angle has continued from stopping of rotation of the crank shaft during starting of the engine. As a result, occurrence of the starting abnormality can be precisely detected without another factor being included.

Due to the fourth feature of the present invention, the first prescribed time is clocked by the timer, so a determination result of occurrence of the starting abnormality can be precisely finalized.

Due to the fifth feature of the present invention, the first prescribed time is a time of 0.3 [s] or less, hence a determination result of occurrence of the starting abnormality can be quickly finalized, and the battery can be promptly protected.

Due to the sixth feature of the present invention, the switch is maintained at OFF even when there is the starting instruction, until a second prescribed time elapses from the switch being set to OFF. As a result, in the second prescribed time, re-starting of the engine is prohibited, so it can be avoided that the starting abnormality repeatedly occurs due to the starting instruction.

Due to the seventh feature of the present invention, when the decompression device does not operate normally, the switch attains an OFF state whereby electric power supply from the battery to the starting motor stops, so said battery can be appropriately protected.

Due to the eighth feature of the present invention, the switch is a relay, hence a large current flowing into the starting motor from the battery can be ON/OFF-controlled with electric power saving during starting of the engine.

Due to the ninth feature of the present invention, blowing of the fuse due to an excessive load on the battery from the starting motor can be prevented by the switch being set to OFF. As a result, a situation of the battery and all being replaced due to blowing of the fuse is avoided, so a burden of a user such as a driver of a vehicle can be reduced.

Due to the tenth feature of the present invention, the battery can be suitably mounted in a vehicle.

Due to the eleventh feature of the present invention, the switch attains an OFF state when occurrence of the starting abnormality is determined, in the case where the start switch continues to be pressed and a signal indicating the starting instruction continues to be inputted to the starting control unit, hence it can be avoided that an excessive load continues to be applied to the battery from the starting motor.

DESCRIPTION OF EMBODIMENTS

A preferred embodiment of the present invention will be presented and described in detail below with reference to the accompanying drawings.

[Configurations of Engine Start Control Device 10 and Vehicle 12]

Figure 1:
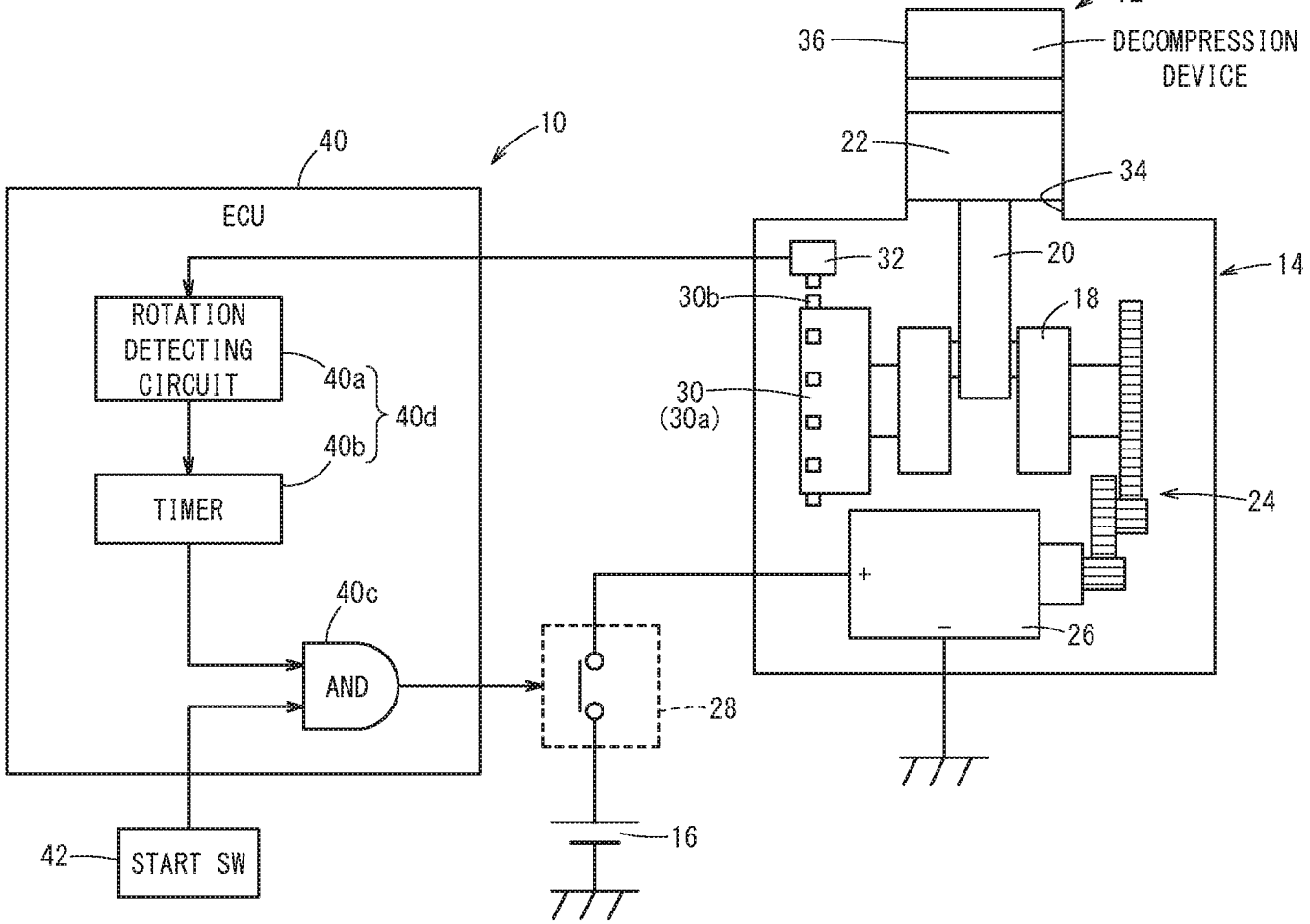
FIG. 1 is a block configuration diagram of a vehicle equipped with an engine start control device according to the present embodiment.

FIG. 1 is a schematic configuration diagram of a vehicle 12 equipped with an engine start control device 10 according to the present embodiment. Note that the present embodiment describes as an example the case of the vehicle 12 being a motorcycle.

The vehicle 12 includes an engine 14 and a battery 16. A piston 22 is coupled, via a connecting rod 20, to a crank shaft 18 (a crank shaft) of the engine 14. One end of the crank shaft 18 is coupled to a starter motor 26 which is a starting motor, via a one-way clutch 24. The one-way clutch 24 is interposingly mounted in order to transmit a driving force (a starting force) of the starter motor 26 from the starter motor 26 to the engine 14.

The starter motor 26 is electrically connected to the battery 16 via a starter relay 28 which is a switch. When the starter relay 28 is ON, electric power is supplied from the battery 16 to the starter motor 26 via the starter relay 28, and the starter motor 26 is driven. As a result, the starting force of the starter motor 26 is transmitted to the crank shaft 18 via the one-way clutch 24, and the crank shaft 18 rotates, whereby the engine 14 can be started.

Figure 2:
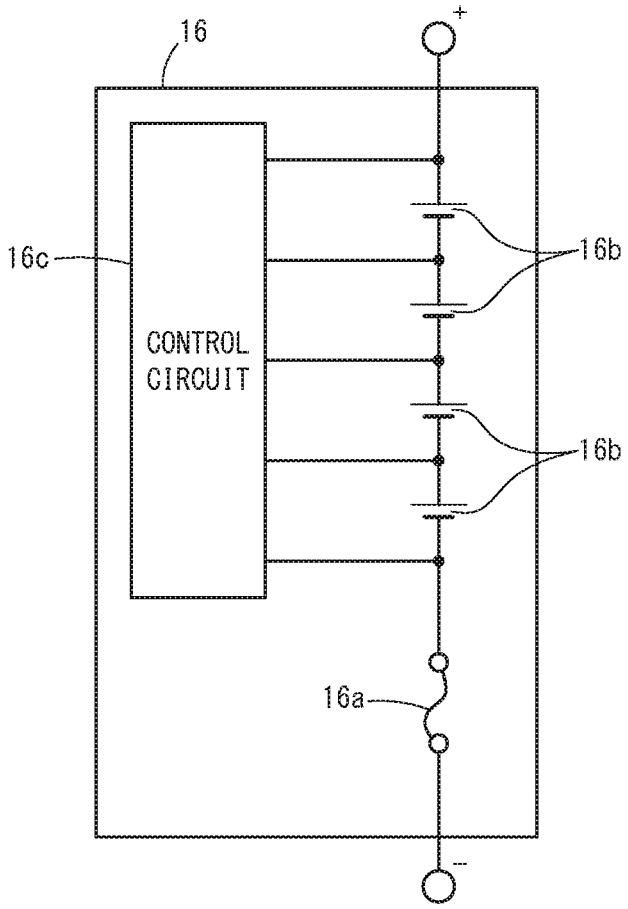
FIG. 2 is a circuit configuration diagram of a battery of FIG. 1.

The battery 16 is a battery for the purpose of engine starting, and, as shown in FIG. 2, is a battery incorporating a fuse 16*a*. The battery 16 is configured by electrically connecting in series a plurality of battery cells 16*b* and the fuse 16*a*, and by a control circuit 16*c* being electrically connected to both ends of each of the battery cells 16*b*. In this case, the plurality of battery cells 16*b* have their positive electrode side (a positive electrode side of the battery 16 of FIG. 1) electrically connected to the starter relay 28, while having their negative electrode side (a negative electrode side of the battery 16 of FIG. 1) electrically connected to earth via the fuse 16*a*. The control circuit 16*c* is a protective circuit of each of the battery cells 16*b*.

Returning to FIG. 1, the other end of the crank shaft 18 is coupled to an ACG 30 being a three-phase alternating current type generator-motor. After starting of the engine 14, the ACG 30 generates electricity due to rotation of the crank shaft 18, and charges another battery with generated electric power. Note that it is also possible for the ACG 30 to function as a starter motor and rotate the crank shaft 18, during starting of the engine 14. In the description below, the case of the crank shaft 18 being rotated and the engine 14 being started by the starter motor 26 will be described.

The ACG 30 is an outer rotor type or inner rotor type rotary electrical device, and, for example, has a plurality of projections 30*b* provided at a certain angular interval θ (for example, θ=20°) along a circumferential direction, on an outer circumferential surface of a rotor 30*a*. A rotor angle sensor 32 as a pulse sensor is provided to the ACG 30 in such a manner that the rotor angle sensor 32 faces the outer circumferential surface of the rotor 30*a*. The rotor angle sensor 32 detects the projection 30*b*, and outputs as a pulse signal a rotation angle corresponding to the number of projections 30*b* that have been detected.

In addition, the engine 14 further includes a decompression device 36 that reduces a pressure (releases compressed air) present in a cylinder 34 during starting of said engine 14.

The above-mentioned starter relay 28 is ON/OFF-controlled by an ECU (Engine Control Unit) 40 of the vehicle 12. Moreover, the pulse signal outputted by the rotor angle sensor 32 is inputted to the ECU 40.

The engine start control device 10 includes the starter relay 28, the rotor angle sensor 32, and the ECU 40. The ECU 40 is a calculator including a microcomputer, and includes the likes of a CPU (Central Processing Unit) and a memory. The ECU 40 reads and executes a program recorded in the memory as a non-transient recording medium, and is thereby capable of realizing functions described below.

That is, the ECU 40 includes a rotation detecting circuit 40*a*, a timer 40*b*, and an AND circuit 40*c*. In this case, a starting abnormality determining means 40*d* that determines occurrence of a starting abnormality of the engine 14 is configured by the rotation detecting circuit 40*a* and the timer 40*b*, and the AND circuit 40*c* functions as a starting control means that controls ON/OFF of the starter relay 28, based on a determination result of the starting abnormality determining means 40*d*. Note that a starting abnormality of the engine 14 refers to a state where during starting of the engine 14, rotation of the crank shaft 18 stops regardless of the starting force being transmitted from the starter motor 26 to the crank shaft 18 to rotate said crank shaft 18, and is due to the decompression device 36 not operating normally during starting of the engine 14.

The rotation detecting circuit 40*a* detects whether rotation of (the crank shaft 18 coupled to) the rotor 30*a* of the ACG 30 has stopped or not, based on the pulse signal inputted to the ECU 40, and by detecting stopping of rotation, determines that a starting abnormality of the engine 14 has occurred. This determination result is notified to the timer 40*b*.

The timer 40*b* starts clocking (measuring time) when a start switch 42 provided to the vehicle 12 is pressed by the driver whereby a starting instruction signal instructing starting of the engine 14 is inputted to the ECU 40 from said start switch 42, and outputs to the AND circuit 40*c* a timer signal indicating that clocking is underway. Then, when, after the determination result indicating occurrence of a starting abnormality of the engine 14 has been notified from the rotation detecting circuit 40*a*, the starting abnormality continues (the determination result is continuously notified from the rotation detecting circuit 40*a*) even when a certain first prescribed time Tth (for example, a time of 0.3 [s] or less) elapses from a time that the starting abnormality occurred, the timer 40*b* stops clocking and stops output to the AND circuit 40*c* of the timer signal. The above-described determination result is finalized by stopping of output of the timer signal.

Figure 3:
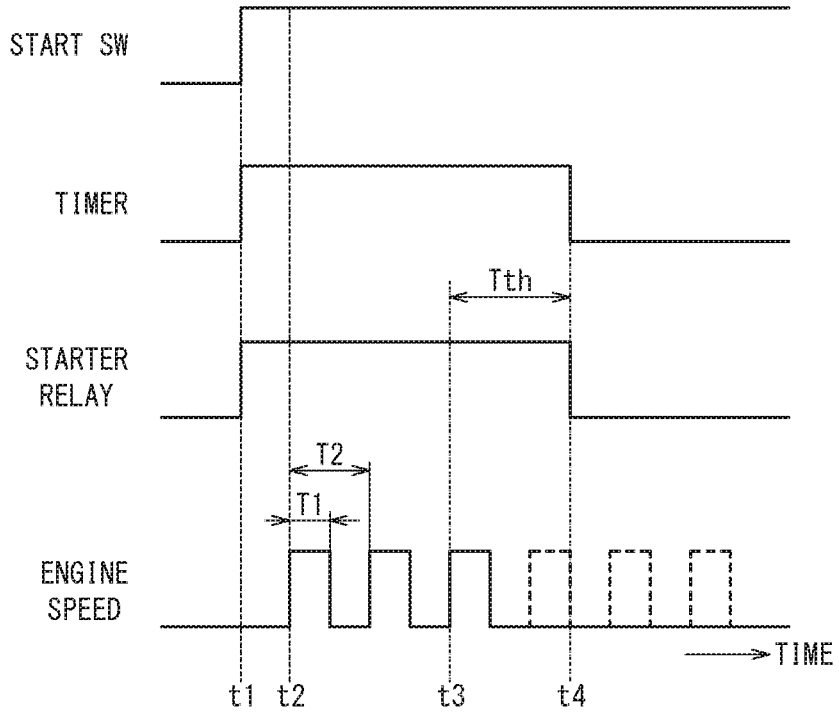
FIG. 3 is a timing chart showing operation of the engine start control device of FIG. 1.

Note that an occurrence time of a starting abnormality refers to a time point when a last pulse has been inputted to the rotation detecting circuit 40*a* (a time point t3 of a rising edge of the last pulse), during starting of the engine 14, as shown in FIG. 3, for example, and the first prescribed time Tth refers to a certain time from this time point t3. That is, this is because when a next pulse is not inputted after the last pulse has been inputted, it can be judged by a rotation angle between the projection 30*b* corresponding to the last pulse and the next projection 30*b* that the rotor 30*a* and the crank shaft 18 have stopped their rotation.

The AND circuit 40*c*, when inputted with the starting instruction signal from the start switch 42 and inputted with the timer signal from the timer 40*b*, supplies a control signal of high level to the starter relay 28, and sets the starter relay 28 to ON. This makes it possible for electric power to be supplied to the starter motor 26 from (each of the battery cells 16*b* of) the battery 16 via the starter relay 28, and for the engine 14 to be started.

On the other hand, when the driver takes their hand away from the start switch 42 and output of the starting instruction signal from said start switch 42 to the AND circuit 40*c* stops, or when output of the timer signal from the timer 40*b* to the AND circuit 40*c* stops, the AND circuit 40*c* stops supply of the control signal to the starter relay 28. This results in the starter relay 28 switching to OFF and electric power supply from the battery 16 to the starter motor 26 stopping, whereby a starting operation of the engine 14 stops.

[Operation of Engine Start Control Device 10]

Figure 4:
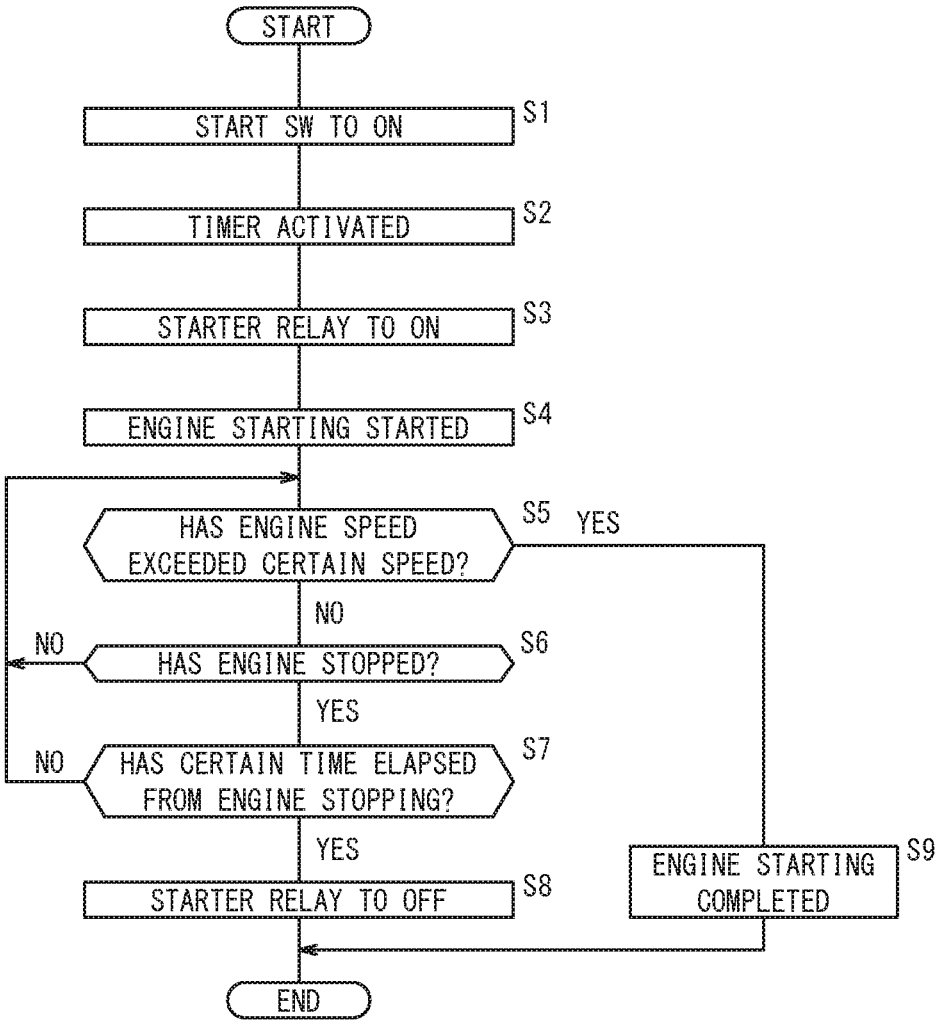
FIG. 4 is a flowchart showing operation of the engine start control device of FIG. 1.

Operation of the engine start control device 10 according to the present embodiment configured in this way will be described with reference to FIGS. 2-4. In this operation description, description will be made with reference also to FIGS. 1 and 2, as required. Description will be made here of the case where when the driver continues to press the start switch 42 and the starting instruction of the engine 14 is continued, a starting abnormality of the engine 14 has occurred.

In step S1, when the driver presses the start switch 42 at time point t1, the starting instruction signal is outputted to the ECU 40 from the start switch 42. Consequently, in step S2, the timer 40*b* starts clocking, and starts output of the timer signal. As a result, in step S3, the AND circuit 40*c* starts output of the control signal to the starter relay 28, based on input of the starting instruction signal and the timer signal. The starter relay 28 attains an ON state based on supply of the control signal, and electrically connects (each of the battery cells 16*b* of) the battery 16 and the starter motor 26.

As a result, in step S4, at time point t2, the battery 16 starts electric power supply to the starter motor 26 via the starter relay 28, and drives the starter motor 26. The starter motor 26 transmits the starting force to the crank shaft 18 via the one-way clutch 24 and rotates the crank shaft 18, thereby causing starting of the engine 14 to be started. Due to rotation of the crank shaft 18, the rotor 30*a* also rotates, hence the rotor angle sensor 32 detects the projection 30*b* of the rotating rotor 30*a*, and outputs that detection result to the ECU 40 as the pulse signal.

The projections 30*b* are provided to the rotor 30*a* at the certain angular interval θ. Therefore, when the rotor 30*a* is rotating, that pulse signal represents a signal of a repeating pulse whose pulse width is a time T1 that the projection 30*b* is detected and whose period is a moving time T2 between each of the projections 30*b* corresponding to the angular interval θ.

In step S5, the rotation detecting circuit 40*a* determines whether an engine speed corresponding to the pulse signal has exceeded a certain speed (for example, an idling speed), or not, based on the inputted pulse signal.

If the engine speed is the certain speed or less (step S5: NO), then in next step S6, the rotation detecting circuit 40*a* determines whether (rotation of the crank shaft 18 of) the engine 14 has stopped, or not. Specifically, the rotation detecting circuit 40*a* detects whether input of the pulse corresponding to the projection 30*b* has stopped in the course of the pulse signal, or not.

If the engine 14 has not stopped (step S6: NO), the rotation detecting circuit 40*a* returns to step S5 and repeatedly executes the determination processing of steps S5, S6.

On the other hand, if the pulse corresponding to the projection 30*b* has not been inputted, specifically if, after there has been input of the last pulse at time point t3, there is no input of a new pulse (step S6: YES), then the rotation detecting circuit 40*a* determines that due to the decompression device 36 not operating normally, rotation of the crank shaft 18 has stopped, and a starting abnormality of the engine 14 has occurred. Then, the rotation detecting circuit 40*a* outputs that determination result to the timer 40*b*.

In next step S7, in the case of the above-described determination result having been inputted from the rotation detecting circuit 40*a*, the timer 40*b* determines whether the first prescribed time Tth has elapsed from the time point t3 at which the starting abnormality of the engine 14 occurred.

If the first prescribed time Tth has not elapsed from the time point t3 (step S7: NO), then operation returns to step S5, and the determination processing of steps S5-S7 is repeatedly executed in the starting abnormality determining means 40*d*. That is, this is because there is a possibility that, even though the rotation detecting circuit 40*a* has once determined occurrence of the starting abnormality of the engine 14, subsequently, rotation of the crank shaft 18 resumes, whereby a new pulse is inputted. Note that if a negative determination result has occurred in step S7 (step S7: NO), it is desirable that when a new pulse has been inputted, the timer 40*b* stops clocking of the first prescribed time Tth from the time point t3 and is reset.

Then, in step S7, if, even at time point t4 when the first prescribed time Tth has elapsed from the time point t3, the determination result indicating occurrence of the starting abnormality of the engine 14 (step S6: YES) is inputted to the timer 40*b* from the rotation detecting circuit 40*a* (step S7: YES), then in step S8, the timer 40*b* stops clocking and is reset. As a result, output of the timer signal from the timer 40*b* stops, and the determination result indicating occurrence of the starting abnormality of the engine 14 is finalized. By supply of the timer signal stopping, the AND circuit 40*c* stops supply of the control signal to the starter relay 28. Consequently, the starter relay 28 is switched from ON to OFF, and electrical connection of the battery 16 and the starter motor 26 is broken. As a result, electric power supply from the battery 16 to the starter motor 26 stops, and the starter motor 26 stops driving.

Note that in step S5, if the engine speed has exceeded the certain speed (step S5: YES), then starting of the engine 14 is determined to have succeeded, and the starting operation of the engine 14 is completed. In this case, for example, the ECU 40 displays something in an unillustrated display device to the effect that the starting operation of the engine 14 has been completed, and the driver who has visually recognized this display content can take their hand away from the start switch 42.

Advantages of Present Embodiment

As described above, due to the engine start control device 10 according to the present embodiment, when occurrence of the starting abnormality of the engine 14 has been determined, the starter relay 28 is set to OFF whereby electric power supply from the battery 16 to the starter motor 26 is stopped. As a result, an excessive load is not applied to the battery 16 from the starter motor 26, hence said battery 16 can be appropriately protected. Moreover, by the starter relay 28 being promptly set to OFF, it can be avoided that an excessive load is applied to the battery 16 at a time of a starting abnormality of the engine 14, so a wiring connected to a terminal of the battery 16 can be thinned (a cross-sectional area of the wiring can be reduced).

Moreover, in the present embodiment, a determination result of occurrence of the starting abnormality of the engine 14 is finalized at time point t4 when the first prescribed time Tth has elapsed from occurrence (time point t3) of said starting abnormality. This makes it possible for setting of the starter relay 28 to OFF to be accurately performed based on the finalized determination result.

Furthermore, in the present embodiment, during starting of the engine 14, a determination result of occurrence of the starting abnormality is finalized when a state of not rotating as far as a certain angle corresponding to the first prescribed time Tth has continued from stopping of rotation of the crank shaft 18. As a result, occurrence of the starting abnormality can be precisely detected without another factor being included.

Yet further, the first prescribed time Tth is clocked by the timer 40*b*, so a determination result of occurrence of the starting abnormality can be precisely finalized. Moreover, the first prescribed time Tth is a time of 0.3 [s] or less, hence the determination result of occurrence of the starting abnormality can be quickly finalized, and the battery 16 can be promptly protected.

Moreover, when the decompression device 36 does not operate normally, the starter relay 28 attains an OFF state whereby electric power supply from the battery 16 to the starter motor 26 stops, so said battery 16 can be appropriately protected.

Furthermore, by employing the starter relay 28 as a switch electrically connecting the battery 16 and the starter motor 26, it is possible for a large current flowing from the battery 16 into the starter motor 26 to be ON/OFF-controlled with electric power being saved during starting of the engine 14.

In this case, blowing of the fuse 16*a* incorporated in the battery 16 due to an excessive load on said battery 16 from the starter motor 26 can be prevented by the starter relay 28 being set to OFF. As a result, a situation of the entire battery 16 being replaced due to blowing of the fuse 16*a* is avoided, so a burden of a user such as the driver of the vehicle 12 can be reduced.

Moreover, since the battery 16 is a battery including the plurality of battery cells 16*b*, said battery 16 can be suitably mounted in the vehicle 12.

Furthermore, the starter relay 28 attains an OFF state when occurrence of the starting abnormality is determined, in the case where the start switch 42 continues to be pressed and the starting instruction signal continues to be inputted to the AND circuit 40*c*, hence it can be avoided that an excessive load continues to be applied to the battery 16 from the starter motor 26.

Modified Example of Present Embodiment

Figure 5:
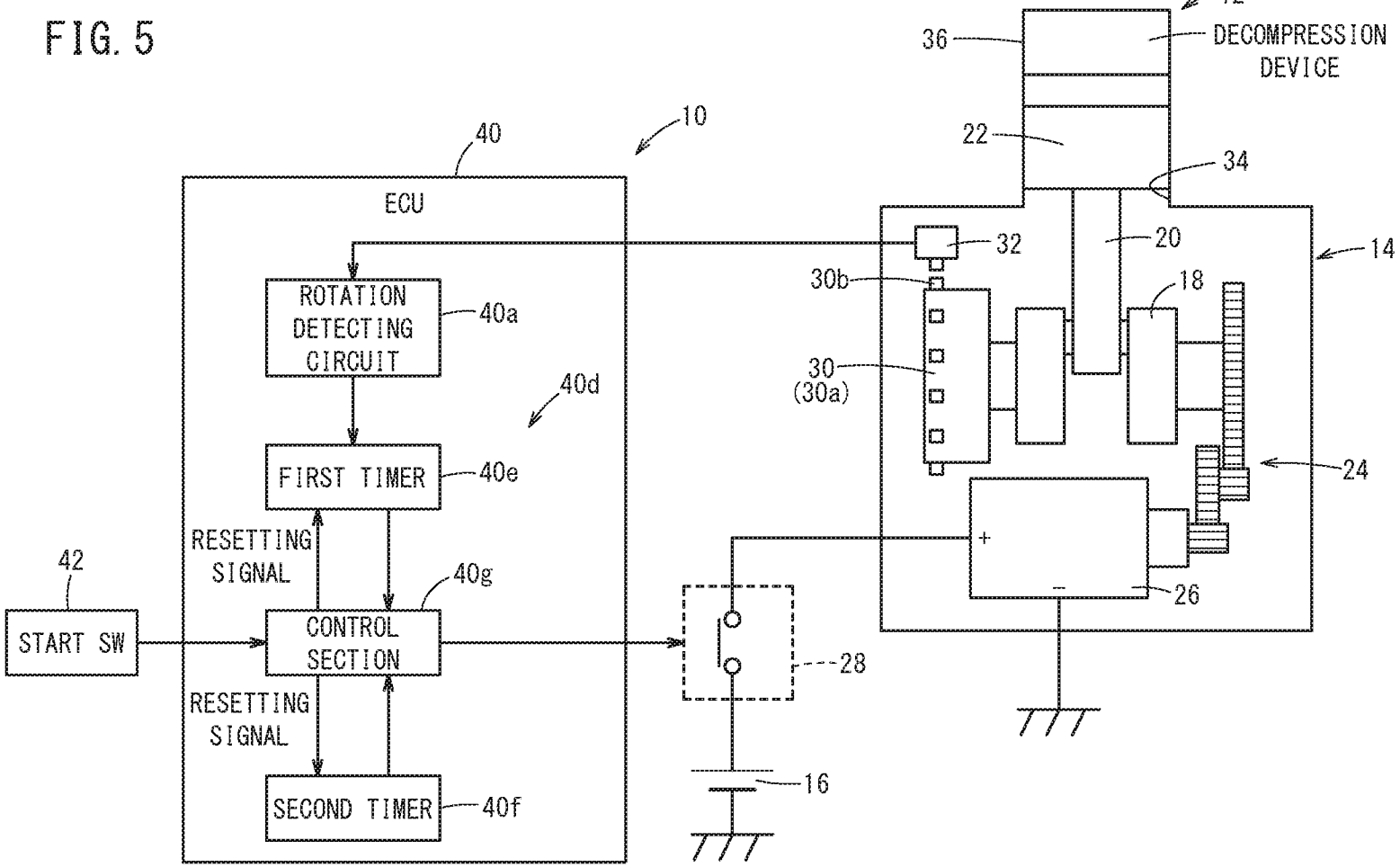
FIG. 5 is a block configuration diagram of a vehicle including another configuration example of the engine start control device of FIG. 1.
Figure 6:
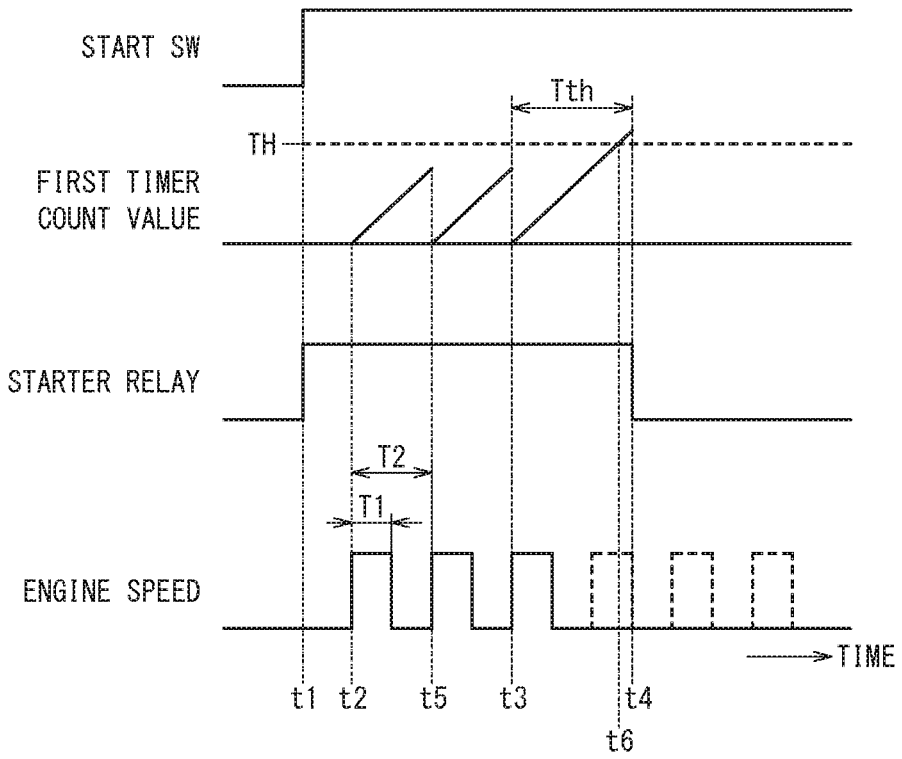
FIG. 6 is a timing chart showing a first operation of the engine start control device of FIG. 5.
Figure 7:
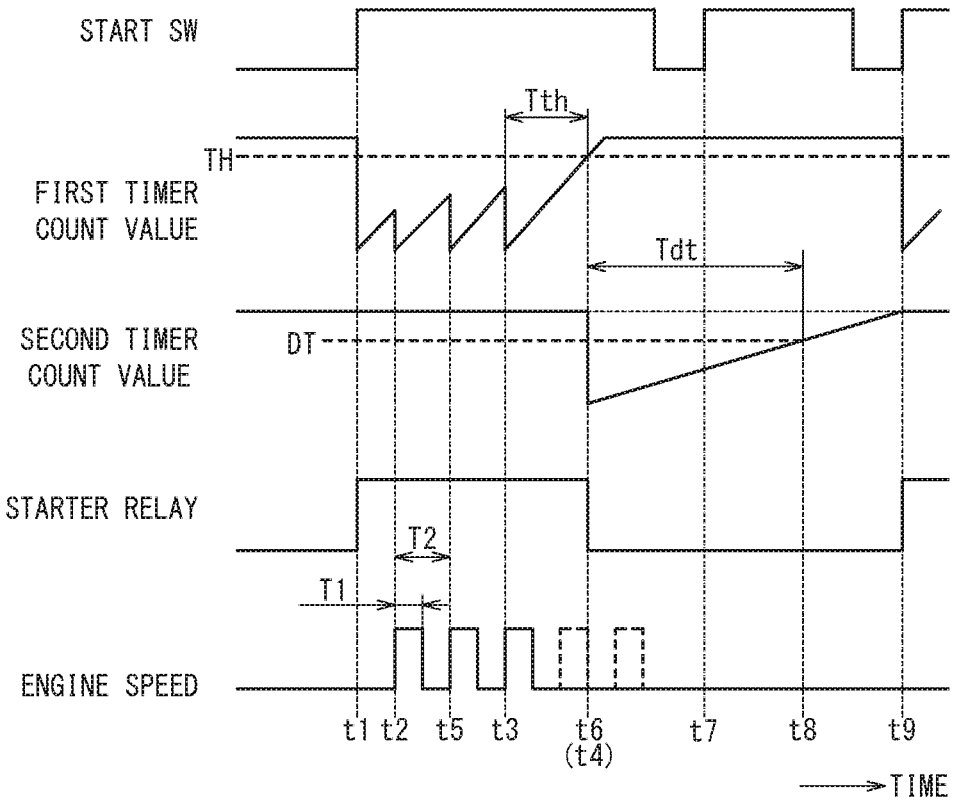
FIG. 7 is a timing chart showing a second operation of the engine start control device of FIG. 5.

Next, a modified example of the present embodiment will be described with reference to FIGS. 5-7. In this modified example, as shown in FIG. 5, a configuration differs from that of FIG. 1 in that the starting abnormality determining means 40*d* is configured from the previously mentioned rotation detecting circuit 40*a* and a first timer 40*e* and second timer 40*f* being counters, and in that a control unit 40*g*, instead of the AND circuit 40*c*, is provided in the ECU 40. In the modified example of FIG. 5, the engine start control device 10 performs a first operation of FIG. 6 or a second operation of FIG. 7 that will be described below.

First, the first operation will be described with reference to FIGS. 5 and 6. The first timer 40*e* is a digital timer that counts up in a certain time interval. That is, for the pulse signal inputted to the rotation detecting circuit 40*a*, the first timer 40*e* starts counting from a rising edge of an arbitrary pulse (for example, time point t2), and counts up, in the certain time interval, to a rising edge of the next pulse (for example, time point t5 at which the moving time T2 has passed from time point t2). Then, upon clocking (counting up) to the rising edge of the next pulse, the first timer 40*e* resets a count value, and starts counting up for the next pulse.

Note that resetting of the count value is performed by supply of a resetting signal from the rotation detecting circuit 40*a*. That is, by the rotation detecting circuit 40*a* outputting to the first timer 40*e* as the resetting signal a signal notifying the rising edge of the next pulse, the first timer 40*e* can efficiently reset the count value.

The second timer 40*f*, which is also a digital timer that counts up in a certain time interval, starts counting up when the starting instruction signal is inputted from the start switch 42, and resets the count value by supply of a resetting signal from the control unit 40*g*. The control unit 40*g*, in the case that the starting instruction signal is inputted from the start switch 42 and the first timer 40*e* is performing a counting operation, supplies a control signal to the starter relay 28 to set said starter relay 28 to ON.

Incidentally, even when a last pulse is inputted at time point t3 and there is subsequently no input of a new pulse, the first timer 40*e* continues to perform counting up. As a result, at time point t6, the count value of the first timer 40*e* reaches a certain threshold value TH.

Accordingly, the control unit 40*g*, in the case where it continues to cause the second timer 40*f* to execute counting up from time point t3 and the first timer 40*e* is counting up even at time point t4 when the first prescribed time Tth has elapsed from time point t3, supplies the resetting signal to both of the first timer 40*e* and the second timer 40*f* to reset the resetting values of the first timer 40*e* and the second timer 40*f*, and stops a counting up operation. That is, this is because in the case where the first timer 40*e* is counting up having exceeded the threshold value TH even when the first prescribed time Tth has elapsed from time point t3, it is conceivable that a state of rotation of the crank shaft 18 having stopped has continued, and a starting abnormality of the engine 14 has occurred. Then, the control unit 40*g* stops supply of the control signal to the starter relay 28, and sets said starter relay 28 to OFF.

In this first operation, although the first timer 40*e* and the second timer 40*f* are digital timers performing a counting up operation, the control unit 40*g* stops supply of the control signal to the starter relay 28 when the first prescribed time Tth elapses. Of course, even in this case, the above-mentioned advantages due to the present embodiment are easily obtained.

Next, the second operation will be described with reference to FIGS. 5 and 7. In the second operation, the first timer 40*e*, although being a digital timer that counts up in a certain time interval, operates at all times, and when the count value reaches a determined upper limit value, holds that value. Note that the upper limit value is set to a count value having sufficient leeway with respect to a count value (the threshold value TH) corresponding to the first prescribed time Tth.

Resetting of the count value of the first timer 40*e* is performed by supply of a resetting signal from the control unit 40*g* or the rotation detecting circuit 40*a*. That is, the control unit 40*g* supplies the resetting signal to the first timer 40*e* to reset the count value of the first timer 40*e* at a timing of setting the starter relay 28 to ON. On the other hand, the rotation detecting circuit 40*a*, similarly to in the case of the first operation, resets the count value of the first timer 40*e* by supplying to the first timer 40*e* as the resetting signal a signal notifying the rising edge of the pulse.

As a result, in the second operation, a time from the starter relay 28 being set to ON due to the driver pressing the start switch 42 to the pulse being inputted to the rotation detecting circuit 42*a*, and a time between rising edges of arbitrary two pulses can be measured efficiently and accurately.

On the other hand, the second timer 40*f* also is a digital timer that counts up in a certain time interval, operates at all times, and when the count value reaches a determined upper limit value, holds that value. The upper limit value is set to a count value having sufficient leeway with respect to a count value (a threshold value DT) corresponding to a later-mentioned second prescribed time Tdt as a stoppage time.

Then, in the second operation, when a last pulse is inputted at time point t3 and there is subsequently no input of a new pulse, the first timer 40*e* continues to perform counting up. As a result, at time point t6, the count value of the first timer 40*e* reaches the threshold value TH. It should be noted that in the second operation, the threshold value TH is a count value appropriate to the first prescribed time Tth.

Then, at time point t6 when the count value of the first timer 40*e* has reached the threshold value TH, the control unit 40*g* stops supply of the control signal to the starter relay 28, and sets said starter relay 28 to OFF. In addition, the control unit 40*g* supplies the resetting signal to the second timer 40*f* to reset the count value of the second timer 40*f*.

Then, in the case that the count value of the second timer 40*f* is less than the certain threshold value DT, the control unit 40*g* maintains an OFF state of the starter relay 28, even if the driver presses the start switch 42. That is, even if there is supply of the starting instruction signal from the start switch 42, the control unit 40*g* prohibits ON of the starter relay 28 and thereby prohibits re-starting of the engine 14 until the count value of the second timer 40*f* reaches the threshold value DT. As a result, even if the driver once takes their hand away from the start switch 42 after time point t6 and presses the start switch 42 again at time point t7, the count value of the second timer 40*f* is less than the threshold value DT, hence the starter relay 28 is not set to ON.

At time point t8 when the second prescribed time Tdt being the stoppage time has elapsed from time point t6, the count value of the second timer 40*f* reaches the threshold value DT. Then, when the driver presses the start switch 42 again at time point t9, the control unit 40*g* sets the starter relay 28 to ON, and resets the count value of the first timer 40*e*.

In this second operation, the starter relay 28 is set to OFF by detecting the starting abnormality of the engine 14 using the first timer 40*e*, while on the other hand, OFF of the starter relay 28 is maintained and re-starting of the engine 14 is prohibited, even if there is supply of the starting instruction signal from the start switch 42, until the second prescribed time Tdt elapses after detecting the starting abnormality of the engine 14. As a result, repeated occurrence of the starting abnormality of the engine 14 due to supply of the starting instruction signal can be avoided, and overload of the battery 16 or inadvertent heating of the fuse 16*a* can be prevented.

The present invention has been described above using a preferred embodiment. However, a technical range of the present invention is not limited to a descriptive range of the above-described embodiment. It is clear to a person skilled in the art that various alterations or improvements may be added to the above-described embodiment. It is clear from the claims that forms incorporating such alterations or improvements may also be included in the technical range of the present invention. Moreover, the symbols in parentheses described in the claims have been assigned conforming to the symbols in the accompanying drawings for facilitation of understanding of the present invention, and the present invention should not be interpreted as being limited to elements assigned with those symbols.

What is claimed is:

1. An engine start control device that by supplying electric power to a starting motor from a battery and thereby rotating a crank shaft of an engine coupled to the starting motor, starts the engine, the engine start control device comprising:

a switch provided between the battery and the starting motor;

a starting abnormality determining unit that determines whether a starting abnormality of the engine has occurred or not; and a starting control unit that in the case that there has been a starting instruction of the engine from outside, sets the switch to ON to start electric power supply to the starting motor from the battery, while in the case that occurrence of a starting abnormality of the engine has been determined by the starting abnormality determining unit, sets the switch to OFF, wherein the starting abnormality determining unit finalizes a determination result of occurrence of the starting abnormality when a first prescribed time has elapsed from the starting abnormality occurring, the starting control unit sets the switch to OFF based on the finalized determination result, a starting abnormality of the engine refers to a state where during starting of the engine, rotation of the crank shaft stops even when the starting motor rotates the crank shaft, and the starting abnormality determining unit finalizes a determination result of occurrence of the starting abnormality when a state of the crank shaft not rotating as far as a certain angle corresponding to the first prescribed time has continued from the crank shaft stopping rotation.

2. The engine start control device according to claim 1, wherein the starting abnormality determining unit is configured to include a timer that clocks the first prescribed time from occurrence of the starting abnormality.

3. The engine start control device according to claim 1, wherein the first prescribed time is a time of 0.3 [s] or less.

4. The engine start control device according to claim 1, wherein the starting control unit maintains the switch at OFF even when there is a starting instruction of the engine from outside, until a second prescribed time elapses from the switch being set to OFF based on the finalized determination result.

5. The engine start control device according to claim 1, wherein the engine comprises a decompression device that reduces a pressure present in a cylinder during starting of the engine, and the starting abnormality determining unit determines occurrence of the starting abnormality due to the decompression device not operating normally.

6. The engine start control device according to claim 1, wherein the switch is a relay.

7. The engine start control device according to claim 1, wherein the battery incorporates a fuse.

8. The engine start control device according to claim 1, wherein the starting control unit sets the switch to OFF when the starting abnormality determining unit has determined occurrence of the starting abnormality, in the case where a start switch of a vehicle provided with the engine continues to be pressed whereby a signal indicating the starting instruction continues to be outputted from the start switch.

9. An engine start control device that by supplying electric power to a starting motor from a battery and thereby rotating a crank shaft of an engine coupled to the starting motor, starts the engine, the engine start control device comprising:

a switch provided between the battery and the starting motor;

a starting abnormality determining unit that determines whether a starting abnormality of the engine has occurred or not; and a starting control unit that in the case that there has been a starting instruction of the engine from outside, sets the switch to ON to start electric power supply to the starting motor from the battery, while in the case that occurrence of a starting abnormality of the engine has been determined by the starting abnormality determining unit, sets the switch to OFF, wherein the starting abnormality determining unit finalizes a determination result of occurrence of the starting abnormality when a first prescribed time has elapsed from the starting abnormality occurring, the starting control unit sets the switch to OFF based on the finalized determination result, the engine comprises a decompression device that reduces a pressure present in a cylinder during starting of the engine, and the starting abnormality determining unit determines occurrence of the starting abnormality due to the decompression device not operating normally.

10. The engine start control device according to claim 9, wherein a starting abnormality of the engine refers to a state where during starting of the engine, rotation of the crank shaft stops even when the starting motor rotates the crank shaft, and the starting abnormality determining unit finalizes a determination result of occurrence of the starting abnormality when a state of the crank shaft not rotating as far as a certain angle corresponding to the first prescribed time has continued from the crank shaft stopping rotation.

11. The engine start control device according to claim 9, wherein the starting abnormality determining unit is configured to include a timer that clocks the first prescribed time from occurrence of the starting abnormality.

12. The engine start control device according to claim 9, wherein the first prescribed time is a time of 0.3 [s] or less.

13. The engine start control device according to claim 9, wherein the starting control unit maintains the switch at OFF even when there is a starting instruction of the engine from outside, until a second prescribed time elapses from the switch being set to OFF based on the finalized determination result.

14. The engine start control device according to claim 9, wherein the switch is a relay.

15. The engine start control device according to claim 9, wherein the battery incorporates a fuse.

16. The engine start control device according to claim 9, wherein the starting control unit sets the switch to OFF when the starting abnormality determining unit has determined occurrence of the starting abnormality, in the case where a start switch of a vehicle provided with the engine continues to be pressed whereby a signal indicating the starting instruction continues to be outputted from the start switch.

* * * * *